United States Patent [19]

German

[11] 3,996,780

[45] Dec. 14, 1976

[54] METHOD AND APPARATUS FOR MAKING AN IMPROVED SERRATED GRATING BAR

[75] Inventor: Wayne Dean German, Hastings, Nebr.

[73] Assignee: Dravo Corporation, Pittsburgh, Pa.

[22] Filed: July 2, 1975

[21] Appl. No.: 592,377

[52] U.S. Cl. ..... 72/187; 72/197

[51] Int. Cl.[2] ..... B21H 7/00; B21H 8/00

[58] Field of Search ..... 72/190, 196, 197, 187; 29/160

[56] References Cited

UNITED STATES PATENTS

| | | | |
|---|---|---|---|
| 2,134,526 | 10/1938 | McLaughlin | 72/187 |
| 3,646,794 | 3/1972 | Tishken | 72/187 |

*Primary Examiner*—Lowell A. Larson

*Attorney, Agent, or Firm*—Parmelee, Miller, Welsh & Kratz

[57] ABSTRACT

A new and improved serrated grating bar is produced directly from coiled strip workstock by applying torque to a toothed notching wheel to draw the strip between the toothed wheel and a bearing wheel spaced apart a distance less than the width of the strip, and by simultaneously confining the lateral faces of the strip to preclude the metal displaced by the teeth from flowing transverse thereto. Apparatus suitable for this purpose includes a toothed wheel flanked on either side by flat discs which extend radially beyond the teeth, a grooved bearing wheel spaced therefrom a distance less than the width of the strip, and means for rotating the toothed wheel. No separate edgers, flatteners or punch presses are required.

7 Claims, 7 Drawing Figures

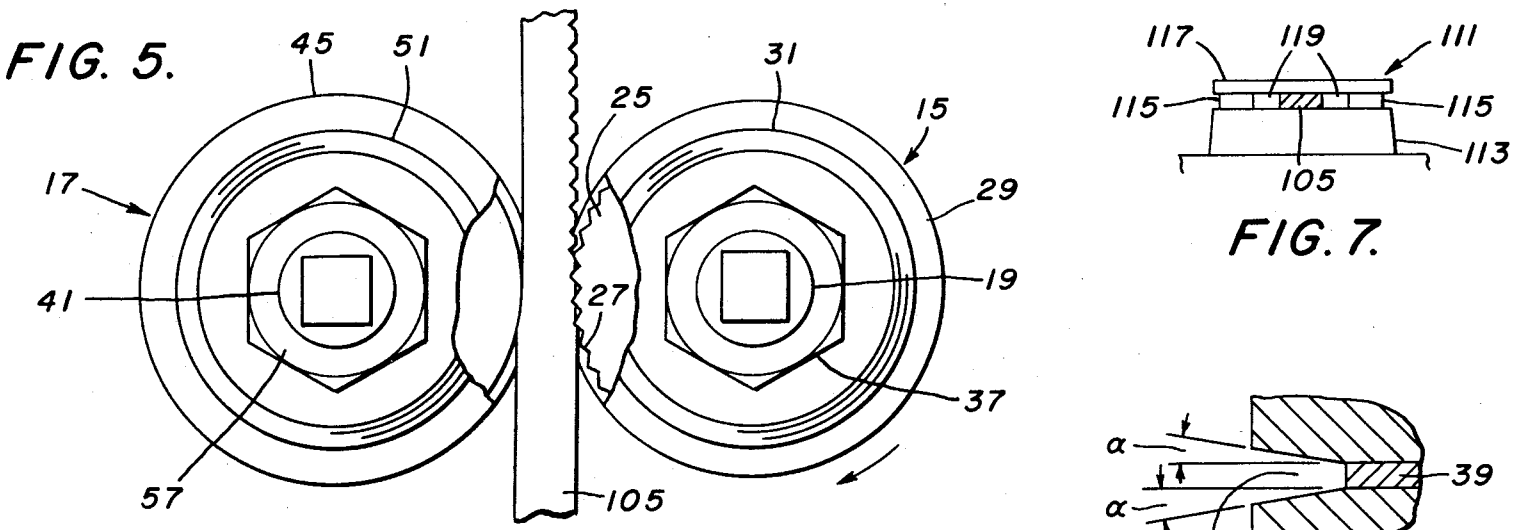
FIG. 5.
FIG. 7.
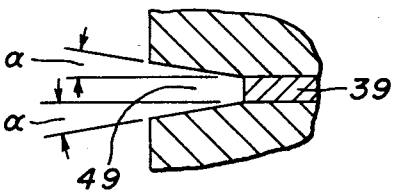
FIG. 6.
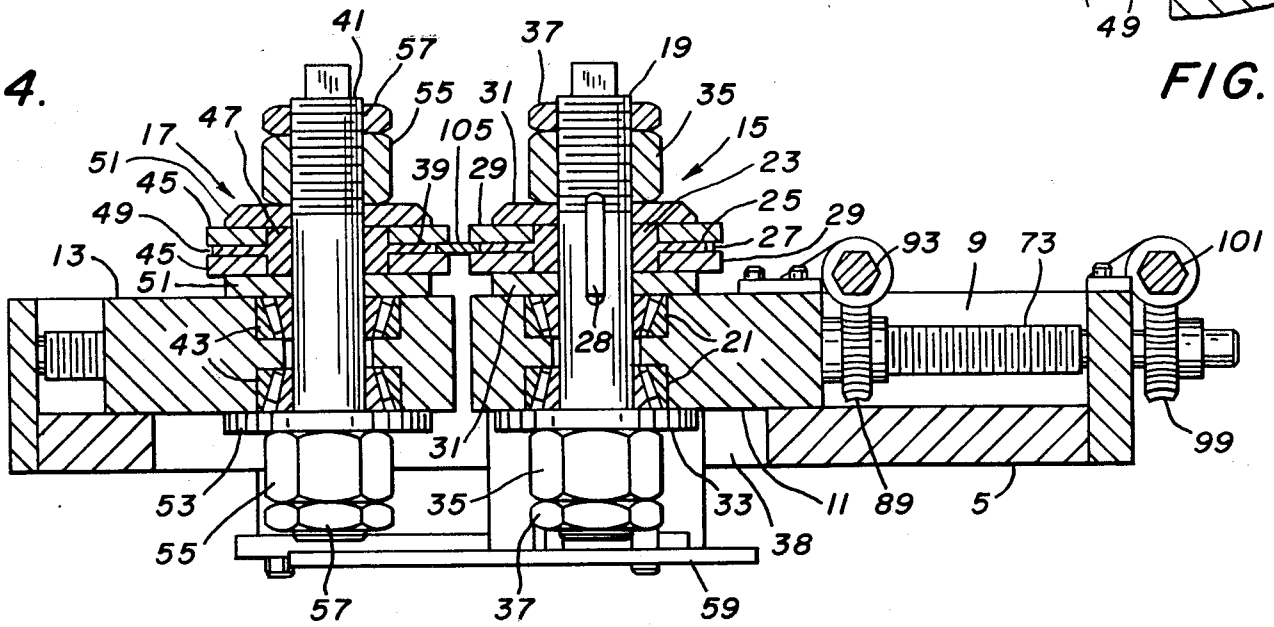
FIG. 4.

METHOD AND APPARATUS FOR MAKING AN IMPROVED SERRATED GRATING BAR

BACKGROUND OF THE INVENTION

1. Field of the Invention

This invention relates to serrated grating bars used in making platforms and walkways for large equipment and other industrial uses, and to methods and apparatus for making such grating bars.

2. Prior Art

Grating workstock is usually hot rolled low-carbon steel although aluminum or other suitable metals are sometimes used. The material comes in the form of coiled stripes which are not suitable for serrating, being distorted by the slitting and coiling operations. In addition to having edges which are not square and which may be burred, the hot rolled steel has a coating of hard mill scale which must be removed.

The present commercial state of the art is to feed the uncoiled strip into an apparatus called a straightener/-leveler/flattener, for flattening and straightening. It is then passed through another apparatus known as an edger which squares the edges and reduces the burrs. The strip then progresses to a reciprocating punch press operating a cutting die. The die progressively punches out slugs of metal along one edge of the strip to produce the serrations. The serrated bar is then cut to length in other suitable equipment and the lengths are welded together in the desired configuration.

The above method of producing serrated grating bar requires a reinforced base to support the punch press and sufficient space to accommodate the press and other necessary equipment. In addition, this method produces scrap in the form of the blanks punches out by the press and these blanks must be a certain minimum size to preclude chipping of the cutting die. Furthermore, the process is noisy and leaves burrs of sharp edges on the walking surface of the grating bars which present a safety hazard in that a person could be cut if contact is made with the serrated surface of the grating bars.

U.S. Pat. No. 1,636,592 suggests that grating bars can be made by passing straight bar stock between a toothed wheel and a grooved idler wheel to form depressions along one edge of the bar. The metal displaced flows transverse to the edge of the bar to form beads on either side of the depressions thereby providing increased contact area for securing the cross members which are seated in the depressions and welded. U.S. Pat. No. 3,653,245 suggests that serrated grating bars can be made from coiled strip in a similar manner by adding, after the toothed wheel, a straightener to remove the camber or curvature of the bar toward the notched edge, an edger to remove the burrs and square the edges and a flattener to remove the curvature about the longitudinal axis of the bar produced by notching and to roll out the metal displaced laterally during notching. The forces required to make the notches in the edge of the strip have a tendency to twist the bar about the longitudinal axis during notching, causing distortion in the serrations which is not removed and, in fact, is aggravated by the subsequent operations performed on the serrated bar. Furthermore, the rolling out of the metal displaced by the notches tends to cause excessive work hardening of the steel, resulting in a high ratio of yield strength/ultimate strength accompanied with a relatively low percent elongation which, in addition to the distortion in the serrations, detracts from the commercial appeal of the resultant product.

SUMMARY OF THE INVENTION

According to the invention, notched grating bar is made from coiled metal strips by applying torque to a toothed notching wheel to draw the coiled strip between the toothed notching wheel and a smooth bearing wheel spaced apart from the notching wheel a distance less than the width of the strip to effect, through cold working of the strip, longitudinal stretching with resultant flattening of the strip and notching of the edge engaged by the toothed notching wheel. Simultaneously, the lateral faces of the strip adjacent the edges thereof are confined to prevent the cold flow of metal in the strip transverse to the lateral faces. In this manner, a finished, notched grating bar is produced directly from coiled strip without the need to precondition the strip or to flatten, roll out displaced metal or edge the bar after notching.

The invention also encompasses the new and improved grating bar produced by this process. The invention further encompasses apparatus suitable for producing notched grating bars directly from strips of grating bar stock, including a notching roll assembly, comprising a toothed, flat wheel substantially equal in thickness to the grating bar stock and a pair of discs concentrically mounted on either side of the toothed wheel. Each disc has a flat surface which bears against the respective side of the toothed wheel and extends radially outward beyond the periphery of the teeth. The apparatus also includes a bearing roll assembly comprising a bearing roll having a smooth bottomed groove therein of a width substantially equal to the thickness of the grating bar stock. The notching roll assembly and the bearing roll assembly are rotatably mounted in spaced relation with the groove in the bearing roll and the teeth of the toothed wheel aligned and separated by a distance less than the width of the strip. The notching wheel assembly is rotated by drive means to draw the strip through the opening between the toothed wheel of the notching roll assembly and the groove in the bearing roll to simultaneously effect feeding of the strip, flattening of the strip through elongation thereof as it is drawn through the restricted opening, notching of the edge of the strip engaged by the toothed wheel without concomitant cold flow of metal transverse to the teeth on the toothed wheel due to the restriction thereof by the flat discs embracing the toothed wheel, and edging of both edges of the strip.

Preferably, the apparatus is provided with means for adjusting the position of the notching roll assembly and the bearing roll assembly as a unit transverse to the center line of means which guide the feeding of the strip into the apparatus and for independently adjusting the distance between the notching wheel assembly and the bearing roll assembly.

In this manner, a notched grating bar of improved quality is produced directly from coiled strip material with considerably less equipment, requiring much less space than is required by the prior art methods. Furthermore, the improved grating bar is produced with much less noise and at about three times the speed as that produced by the present commercial punch press method.

BRIEF DESCRIPTION OF THE DRAWINGS

FIG. 4 is a vertical section view taken along the line IV—IV in FIG. 1;

FIG. 5 is a schematic plan view of the operative parts of the apparatus of the previous views illustrating their engagement with, and notching of, a piece of grating workstock;

FIG. 6 is an enlarged vertical section view of the outer portion of the bearing roll assembly; and FIG. 7 is an enlarged elevation view of the inlet guide unit.

DESCRIPTION OF THE PREFERRED EMBODIMENT

Figure 1:
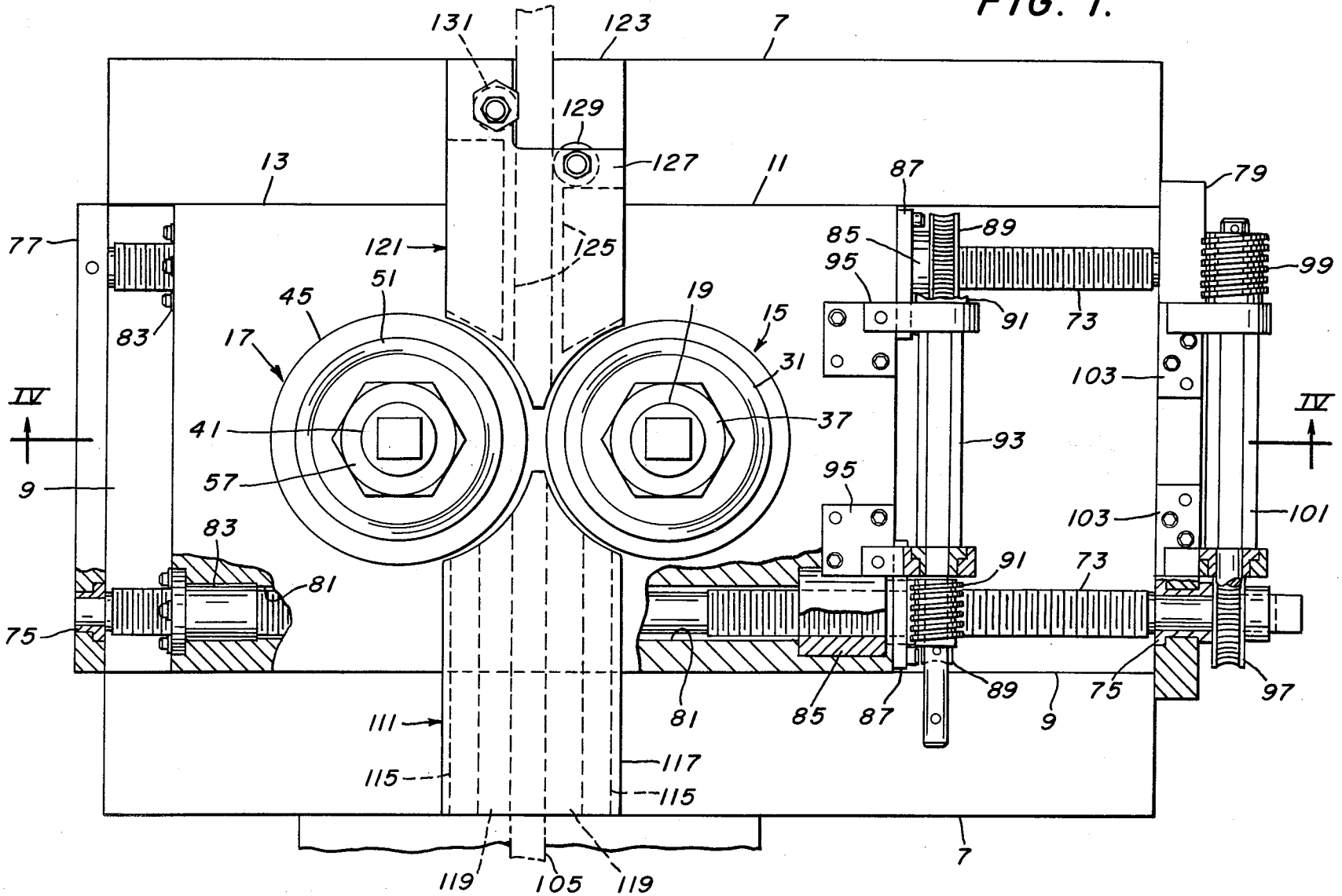
FIG. 1 is a plan view of apparatus suitable for carrying out the invention with some parts broken away and some parts removed for clarity.

Apparatus suitable for carrying out the invention includes a base 1 upon which are mounted four legs 3 supporting a table top 5. Arranged on the table top 5 are guide blocks 7 which form an undercut groove 9 extending the length of the table. A pair of inverted T-shaped sliding blocks 11 and 13 are longitudinally slideable along the undercut groove 9.

Referring to FIG. 4, a notching roll assembly designated generally by the reference character 15 and a bearing roll assembly 17 are mounted on sliding blocks 11 and 13, respectively. The notching roll assembly includes a vertical shaft 19 threaded at both ends and journaled in the sliding block 11 by bearings 21. The collar 23 of a wheel 25 provided with teeth 27 about the periphery thereof is keyed at 28 to the shaft 19 for rotation therewith. A pair of flat discs 29 concentrically mounted above and below the toothed wheel 25 over the collar 23, extend radially outward beyond the teeth 27 projecting from the wheel 25. In addition, a pair of backing pressure plates 31, mounted on the shaft 19, bear against and stiffen the discs 29 against the forces developed during the operation of the apparatus. A bearing backup ring 33 is assembled on the shaft 19 below the sliding block 11. The notching roll assembly is held in place by nuts 35 and jam nuts 37 threaded on the upper and lower ends of the shaft 19, which projects downward through a slot 38 in the table top 5.

In a similar manner, the bearing roll assembly 17 includes a collared bearing wheel 39 mounted on a vertical shaft 41 journaled in the sliding block 13 by bearings 43. A pair of flat discs 45, seated on the collar 47 above and below the bearing wheel 39, extend radially outward beyond the smooth periphery of the bearing wheel 39 to form therewith a smooth bottomed peripheral groove 49 in the bearing roll assembly. Backup pressure plates 51 are provided above and below the discs 45 to stiffen the assembly and a bearing backup ring 53 is provided below the sliding block 13. The bearing roll assembly is secured in place by nuts 55 and jam nuts 57, threaded on the upper and lower ends of the shaft 41.

Figure 3:
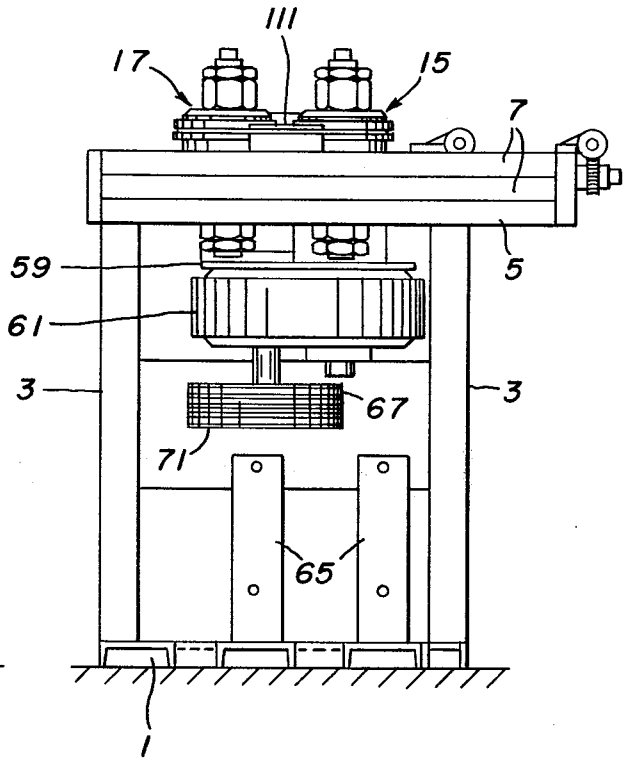
FIG. 3 is a vertical side view of the apparatus shown in FIG. 1 with some parts removed for clarity.
Figure 2:
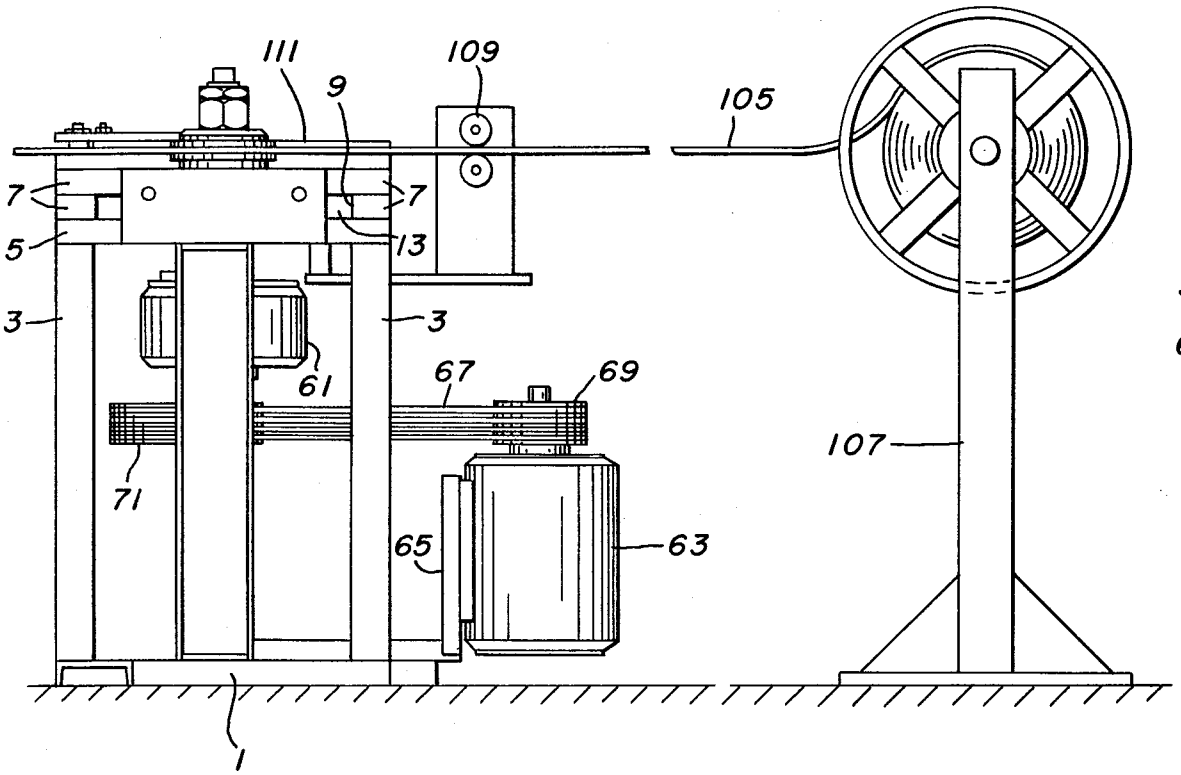
FIG. 2 is a vertical end view of the apparatus shown in FIG. 1.

A plate 59 suspended below the sliding block 11 supports a gear reducer 61 connected to the lower end of the shaft 19 (FIGS. 2 and 3). An electric motor 63 mounted on the side of the apparatus by a frame 65 connected to the base 1 rotates the notching wheel assembly through a multiple strand drive belt 67 which transmits power from a pulley 69 on the vertical shaft of the motor 63 to a second pulley 71 on the input shaft of the gear reducer 61.

The positioning of the sliding blocks 11 and 13 along the undercut groove 9 is effected by a mechanism which includes a pair of threaded shafts 73 axially restrained longitudinally in the groove by bearings 75 in end plates 77 and 79. The shafts 73, having left-hand threads at one end and right-hand threads at the other, pass through longitudinal bores 81 (only one shown) in the sliding blocks 11 and 13 and threadedly engage fixed couplings 83 having left-hand threads bolted to the sliding block 13 and rotatable couplings 85 in sliding block 11. The rotatable couplings 85 are axially restrained in counter bores in sliding block 11 by retainer plates 87. A pair of worm wheels 89 are secured to collars on the couplings 85 which protrude through the retainer plates. The worm wheels 89 are engaged by a pair of worms 91 carried by a hexagonal shaft 93 supported transverse to the shafts 73 by mountings 95 on the sliding block 11. Another set of worm wheels 97 (only one visible in FIG. 1) secured to the ends of threaded shafts 73, extending beyond end plate 79, are engaged by worms 99 (only one visible in FIG. 1), carried by a hexagonal shaft 101 supported transverse to shafts 73 by mountings 103 on end plate 79.

Rotation of the shaft 101 causes simultaneous rotation of the shafts 73 through worms 99 and worm wheels 97. With the threaded couplings 83 fixed to the guide block 13, rotation of the shafts 73 causes guide block 13 to slide in the undercut groove 9 in a direction dependent upon the direction of shaft rotation. Due to the inherent mechanical characteristics of worm gear combinations, the rotatable couplings 85 in the guide block 11 are locked against rotation by the worm wheel 89 and worms 91 so that rotation of the shafts 73 results in sliding of the guide block 11 in the undercut groove 9 in the opposite direction and at the same rate as guide block 13. Thus by rotation of the shaft 101, the guide blocks 11 and 13 may be displaced horizontally along the undercut groove 9 while the centerline between the two remains constant, allowing adjustment for various widths of grating workstock.

On the other hand, rotation of the shaft 93 results in simultaneous rotation of the rotatable couplings 85 in the guide block 11. Since the shafts 73 are locked against rotation by the worm gears 97 and worms 99, rotation of the couplings 85 causes the guide block 11 to move along the shafts 73 independent of the guide block 13. Thus rotation of shaft 101 positions the notching roll assembly 15 and the bearing roll assembly 17 along the undercut groove 9, maintaining the original centerline of the workstock regardless of the stack width, while rotation of the shaft 93 adjusts the distance between the notching and bearing roll assemblies, thus controlling the depth of the notches produced.

The workstock from which the grating bar is made is supplied in the form of a coil of rolled sheet material 105 (FIG. 2) which has been slit to a predetermined width and is rotatably supported by a stand 107. The strip of workstock is led from the coil through a pair of input rollers 109 into an input guide unit 111. The input guide unit which is shown in front elevation in FIG. 7 includes a guide base 113 secured to the fixed guide block 7, two spacers 115 mounted on the guide base along each longitudinal edge thereof and a cover plate 117. A pair of replaceable guides 119 fitted between the spacers 115 define a channel of adjustable width which guides the workstock into the opening between the notching roll and bearing roll assemblies.

Similarly, an outlet guide unit 121 includes a guide base 123, a pair of spacers 125 and a top guide 127. However, in place of the guides 119, the outlet guide unit includes rollers 129 and 131, the peripheral edges of which define the channel for grating bar 105 after it has passed between the notching and bearing roll assemblies. The roller 131 is eccentrically mounted such that various width grating bars may be notched by the machine.

In operation, a roll of coiled workstock 105 is placed on the stand 107. The shaft 93 is rotated to adjust the distance between the notching roll assembly 15 and the bearing roll assembly 17 in the manner described above such that the spacing between the teeth of the notching wheel 25 and the bearing wheel 39 is less than the width of the workstock 105. Next the shaft 101 is rotated to simultaneously adjust the positions of the notching roll assembly 15 and the bearing roll assembly 17 such that the previously set gap between the notching wheel 25 and the bearing wheel is aligned with the channel in the inlet guide unit 111.

With the machine thus set, the motor 63 is energized to rotate the notching roll assembly 15 in the clockwise direction, as viewed in FIGS. 1 and 5. The strip of workstock 105 is then manually fed through the guide rollers 109 into the channel in the inlet guide unit 111 until it is engaged by the teeth 27 on the driven notching wheel 25. The notching wheel positively engages the workstock by forcing the teeth 27 into the strip 105 as the notching roll assembly rotates to pull the strip into the rolls. The pressure of the teeth being forced into the strip results in the strip bearing against the bearing wheel 39 at a stress exceeding the yield strength of the workstock, causing compression of the steel and resulting in plastic deformation of the strip 105. This deformation would normally result in a local thickening of the strip at the point of contact with the rolls, however, since the rolls are provided with a groove around the circumference which accepts the edges of the strip to a depth which is greater than the depth to which the steel tends to thicken, the metal is confined in the thickness dimension. This confinement causes the compressive stress in the metal to increase to a value which is sufficient to produce plastic flowing of the metal (e.g. for steel, approximately 40,000 psi).

Such plastic deformation would be expected to case distortion of the strip at its center where it is not confined by the grooves, however, simultaneously with this lateral compressive stress, the strip is being acted upon by an axial tensile stress in the direction of strip movement produced by the positive engagement of the toothed notching wheel. This simultaneous pulling and squeezing of the strip results in plastic axial elongation and lateral compression of the width while the thickness remains essentially the same as the original strip. Some increase in the thickness occurs at the edges of the strip at the interface of the strip and the bearing and notching roll grooves because the grooves are made about .010 inches wider than the nominal thickness of the strip to accommodate for workstock manufacturing tolerances. As illustrated in the enlarged view of FIG. 6, the sides of the groove 49 in the bearing roll are relieved by an angle $\alpha$ which prevents binding of the workstock in the undriven bearing roll assembly. The angle $\alpha$ is preferably in the range of about 1 to 3 degrees.

The forces developed as the strip is passed through the grooves in the notching and bearing roll assemblies produce a smooth surface on the edges of the strip. Thus the strip is both notched and edged by the roll assemblies thereby eliminating the requirement for separate edging equipment. Furthermore, the plastic flow of the metal which occurs as the strip passes between the roll assemblies causes the mill scale to "pop" off the surface of the metal, thereby eliminating the need to otherwise remove the scale.

Cold working of the steel in the described manner is known to improve the tensile and compressive strength of the steel while increasing the fatique strength. Hardening of the steel, known as work hardening, also occurs through the cold working which should result in a steel grating bar with improved wear characteristics.

The strip which has been simultaneously straightened, notched, edged, descaled, cold worked and hardened by the notching and bearing roll assemblies enters the outlet guide unit 121 as it leaves the roll assemblies and passes between the rollers 129 and 131. These rollers remove any camber or lateral curvature of the strip which may be present depending upon the depth of the notches impressed in the strip. As mentioned previously, the roller 131 is mounted on an eccentric to permit adjustment of the opening between the rollers.

As an example of an improved grating bar produced in the above manner, a piece of low carbon, hot-rolled steel was serrated by passing it through the described apparatus with the following results.

TABLE I

| | |
|---|---|
| Test Strip Before Serrating: | |
| length | = 24' 3" |
| thickness | = .180" |
| width | = 1.220" |
| weight of 12" sample | = 12 ½ oz. |
| Test Strip After Serrating: | |
| length | = 26' 0" |
| thickness: | |
| at serrated edge | = .192" |
| at unserrated edge | = .192" |
| at center | = .180" |
| width | = 1.125" |
| weight of 12" sample | = 11½ oz. |

From this data it can be seen that the test strip was elongated 21 inches or 7.22%, reduced in width 0.095 inches or 7.78% and the weight of a 12 inch section of the strip was reduced by 1 ounce or 8%. The reduction in the weight per unit length of the strip is accounted for in the increase in length and no steel is lost as in the prior art method of punching the notches in the bar stock.

Tests on similar strips of bar stock showed the following improvements in mechanical properties as a result of serrating the strips in the described manner.

TABLE II

| Specimen No. | Condition of Bar | Ultimate Tensile Strength (psi) | Yield Strength (psi) | Elongation in 2" |
|---|---|---|---|---|
| 1A | Unnotched | 49,882 | 35,011 | 35% |
| 2A | Unnotched | 49,706 | 35,680 | 39% |
| 1B | Roll Notched | 60,950 | 56,778 | 16% |
| 2B | Roll Notched | 61,556 | 57,607 | 14% |

The specimens were taken from the center of the test strips and thus represent the properties of the strips at that location. It is evident from the above figures that roll notching significantly increased both the ultimate tensile strength as well as the yield strength of the grating bars.

For the purpose of determining the degree and distribution of work hardening across the width of the strips, a longitudinal section of both the unnotched and roll notched bar were polished and etched to observe the microstructure and to determine the hardness at various locations. The results of the hardness survey are as follows:

TABLE III

| | Knoop Micro-Hardness | Equivalent Brinell Hardness |
|---|---|---|
| 1) Unnotched bar (Bar A) | | |
| Edge no. 1 | 135 | 121 |
| Center of width | 131 | 117 |
| Edge no. 2 | 128 | 115 |
| 2) Notched bar (Bar B) | | |
| Notched edge at top of notch | 174 | 160 |
| Notched edge at bottom of notch | 258 | 237 |
| Center of width | 173 | 159 |
| Unnotched edge | 258 | 237 |

Comparison of the hardness values for the unnotched bar with the roll notched bar indicates the work hardening that occurred during the process. Although work hardening exists across the entire width of the bar, the greatest amount occurs in the area of the notches where plastic deformation is at a maximum.

Examination of the microstructure at the bottom of the notches revealed an elongated grain structure indicative of plastic deformation and no cracks.

Thus the novel process described produces an improved grating bar with increased ultimate tensile strength, hardness and yield strength throughout the entire bar. Keeping in mind that the plastic deformation and, therefore, the amount of work hardening, is greatest at the notched edge and least at the center of the bar, the tensile specimens taken from the center of the width indicate a 22% increase in ultimate strength and a 50–60% increase in yield strength from the process.

The advantages of the invention over the present commercial apparatus and methods for producing serrated grating bars are many. The initial cost of a serrating line is greatly reduced due to a reduction in the processing required since the bars are flattened, leveled, straightened, notched and descaled all at the same time. No punch press and die, no separate straightener/flattener, no separate edger and no slack loop are required, thus the production line is much shorter. No heavy foundation is required as for the punch press. No slugs are produced, hence, there is more efficient use of the steel. The bars are stronger due to the cold working and do not have sharp edges. The machine is self-feeding, thus eliminating the problem of cobbling which is present in the prior art systems. In addition, the production rate is approximately 270 lineal feet per minute which is about three times the present commercial rate. Maintenance expenses are reduced by eliminating much machinery. Electric energy costs are reduced by approximately two thirds over the present commercial line. Replacement tooling costs are also much lower than with the present commercial equipment. Coil changing time is reduced since it is not necessary to thread the stock through straightening and edging equipment. Similarly, noise levels produced by this process are significantly lower and well within present environmental standards. Finally, only one operator is required and he is not exposed to the hazards of a punch press and die, the slack loop and the rotating rolls associated with the straightener/flattener and edgers currently used.

I claim as my invention:

1. A process for producing notched grating bars from a coiled metal strip comprising the steps of:

a. applying torque to a toothed notching wheel for drawing the coiled strip between the toothed notching wheel and a smooth bearing wheel spaced apart from the notching wheel a distance less than the width of the strip to effect, through cold working of the strip, longitudinal stretching with resultant flattening of the strip and notching of the edge engaged by said toothed notching wheel; and b. simultaneously confining the lateral faces of the strip adjacent both edges thereof to effect edging of the strip and to prevent the cold flowing of the metal transverse to said lateral faces whereby a finished, notched grating bar is produced directly from the coiled strip.

2. An improved notched grating bar produced according to the process of claim 1.

3. Apparatus for making notched grating bar from strips of grating bar stock including:

a. a notching roll assembly comprising a flat wheel substantially equal in thickness to the grating bar stock and having suitably shaped radially extending teeth angularly spaced about the periphery thereof, and a pair of discs concentrically mounted on either side of the toothed wheel, each having a flat surface which bears against the respective side of the toothed wheel and extends radially outward beyond the periphery of the teeth;

b. a bearing roll assembly comprising a wheel having a smooth bottomed groove therein of a width substantially equal to the thickness of the grating bar stock, the side walls of the groove being relieved at an angle of about 1 to 3 degrees;

c. mounting means for rotatably mounting said notching roll assembly and said bearing roll assembly in spaced relation with the groove in the bearing wheel and the teeth of the toothed wheel aligned and separated by a distance less than the width of the strip; and d. drive means for rotating said notching wheel assembly to draw said strip through the opening between the toothed wheel to simultaneously effect feeding of the strip, flattening of the strip through elongation thereof as it is drawn through the restricted opening, notching of the edge of the strip engaged by the toothed wheel without concomitant cold flow of metal transverse to the teeth on the toothed wheel due to the restriction thereof by the flat discs embracing the toothed wheel, and edging of both edges of the strip.

4. The apparatus of claim 3 including guide means for guiding the strip of grating bar stock into the opening between the notching roll assembly and the bearing roll assembly and wherein said mounting means includes means for adjusting the position of the notching roll assembly and the bearing roll assembly as a unit relative to the centerline of the guide means and for independently adjusting the distance between the notching roll assembly and the bearing roll assembly.

5. The apparatus of claim 4 wherein said mounting means includes:

a. a base plate;

b. guide blocks mounted on the base plate and defining an undercut groove transverse to the centerline of the guide means;

c. first and second sliding blocks upon which said notching roll assembly and said bearing roll assembly are respectively rotatably mounted, said sliding blocks being slideably retained by the guide blocks in the transverse undercut grooves formed by the guide blocks; and d. adjusting means for sliding said sliding blocks along said undercut groove including a threaded, axially restrained shaft extending the length of said groove and threadably engaging both sliding blocks to effect simultaneous equal movement of both sliding blocks in opposite directions along the undercut groove through rotation of said threaded shaft, one of said sliding blocks engaging said threaded shaft through an axially restrained coupling which is selectively rotatable with respect to the block to effect movement of said one block along the threaded shaft independently of the other sliding block.

6. The apparatus of claim 5 including a second threaded shaft axially restrained in the undercut groove parallel to the first shaft, and threadedly engaging both sliding blocks with said one sliding block being provided with a second coupling which is selectively rotatable therewith, first and second worm wheels mounted on each threaded shaft and a first worm gear engaging both said first and second worm wheels to effect simultaneous rotation of the threaded shafts and to lock them against movement induced by forces applied to said sliding blocks, third and fourth worm wheels mounted on said couplings and a second worm gear engaging said third and fourth worm wheels to effect simultaneous selective rotation of said couplings and to lock them against movement induced by forces applied to the associated sliding block.

7. The apparatus of claim 3 including a roller mounted with its axis of rotation parallel to that of the notching wheel assembly for bearing against the edge of the notched grating bar as it exits from between the notching and bearing wheel assemblies to eliminate the tendency of the grating bar to develop a camber while being notched.

* * * * *